US006350189B1

(12) United States Patent
Tanaka

(10) Patent No.: US 6,350,189 B1
(45) Date of Patent: Feb. 26, 2002

(54) GRINDING DEVICE

(75) Inventor: Minoru Tanaka, Tokyo (JP)

(73) Assignee: Nippon Dia Industry Co., Ltd., Tokyo (JP)

( * ) Notice: Subject to any disclaimer, the term of this patent is extended or adjusted under 35 U.S.C. 154(b) by 0 days.

(21) Appl. No.: 09/610,990

(22) Filed: Jul. 6, 2000

(30) Foreign Application Priority Data

Mar. 3, 2000 (JP) ..... 2000-063329

(51) Int. Cl.[7] ..... B24B 31/00
(52) U.S. Cl. ..... 451/326; 451/327; 451/328
(58) Field of Search ..... 451/32, 326, 327, 451/328, 329, 330

(56) References Cited

U.S. PATENT DOCUMENTS 3,013,365 A * 12/1961 Harper ..... 451/32
3,513,604 A * 5/1970 Matsunaga et al. ..... 451/32
3,579,920 A * 5/1971 Heiberger ..... 451/329
3,609,921 A * 10/1971 Foster et al. ..... 451/329
5,454,749 A * 10/1995 Ohno ..... 451/32
5,531,637 A * 7/1996 Kimura ..... 451/328

* cited by examiner

*Primary Examiner*—Derris H. Banks
(74) *Attorney, Agent, or Firm*—Wenderoth, Lind & Ponack, L.L.P.

(57) ABSTRACT

An object of this invention is to increase strength of the turret plate and to disclose new constitution of a cover portion, a grinding device is constituted of a rotate fly-wheel; a turret plate which is located face to face with the fly-wheel and rotates in synchronization with said fly-wheel, said turret plates being formed in a cross shape with a plurality of leg portions extending in a radial direction thereof; a plurality of grind tubs located rotatably or oscillatably between said fly-wheel and vicinities of front ends of said leg portions of said turret plate, each of which has an opening portion above thereof, a periphery portion of said opening portion in said grind tub provided on said leg portion at a position ending horizontally positioning above said leg portion at a horizontally extending position; a cover portion installable to said opening portion of said grind tub by sliding; a fix means provided between the cover portion and the grind tub; and a reinforcement means provided on the turret plate.

17 Claims, 9 Drawing Sheets

GRINDING DEVICE

BACKGROUND OF THE INVENTION

This invention relates to a grinding device which is such that abrasive materials and worked pieces are thrown into grind tubs and the grind tubs are rotated or oscillated by a fly-wheel and a turret plate to grind and process the worked pieces.

Japanese Patent No. 2,984,996 by this applicant discloses a grinding device 101 as shown in FIGS. 8 through 11.

The grinding device 101 is constituted of both side plates rotating at a desired speed, namely a fly-wheel 102 and a turret plate 103, grind tubs 105 held between the fly-wheel 102 and the turret plate 103, and cover portions 110 each of which closes an opening portion 106 of the grind tub 105.

The turret plate 103 is formed in a cross shape with four leg portions 104 extending in a radial direction thereof Four grind tubs are provided between the leg portions 104 and the fly-wheel 102 rotatably or oscillatably. Furthermore, when one of the leg portions 104 is at a position extending in a horizontal direction, a peripheral portion 107 of the opening portion 106 is positioned above the leg portion 104 extending in the horizontal direction as shown in FIG. 9, so that installation of the cover portion becomes possible.

The cover portion 110 is provided with spacer plates 112 formed unitedly on a peripheral portion 111 in a surface side thereof, and each of the spacer plates 112 positioned backward in an attaching direction of the cover portion 110 is provided with a lack portion 113 at an end portion forward of the attaching direction in the spacer plate 112.

Each of cams 108 has a lower surface formed in an arc shape, a convex guide hook 109 is projected and formed at an end portion forward in the attaching direction of the cover portion 110. The cams 108 is slanted so that each lower portion of the cams is positioned backward in the attaching direction before installation of the cover portion 110 as shown in FIG. 11. When the cover portion 110 is installed on the grind tub 105, the leg portion 104 on which the grind tub 105 is held is made to move at a horizontal position, and then the cover portion 110 is made to arrange a peripheral portion 107 of the grind tub 105 so that an end portion of each spacer plates 112 of the cover portion 110 comes to be in contact with the convex guide hook 109 of each cam 108, the cover portion 110 sliding on the peripheral portion 107 of the grind tub 105. Thereupon, the cams 108 rotate along the spacer plates 112, as shown in FIG. 12, and then the cams 108 are made to erect on the spacer plates 112 to press the spacer plates 112, as a result, the cover portion 110 may close the opening portion 106 of the grind tub 105.

Each leg portion 104 attached on the grind tub 105 into which the abrasive materials and the worked pieces are thrown is mode to move to the horizontal position in t and then the cover portion 105 is installed to the grind tub 105 moved to the horizontal position in turn. After that, the fly-wheel is made to be rotated in order to rote or oscillate the grind tub 105, as a result, the worked pieces may be grinded by colliding the abrasive materials and the worked pieces in the grind tub 105.

As explained above, in Japanese Patent No. 2984996 by this applicant, as the turret plate is formed in a cross shape, the cover portion can be installed on the opening of the grind tub by sliding the cover portion, thus, reduction of a setting space necessary to the whole of the grinding device can be designed. Furthermore, because the cover portion is slide to be installed to the grind tub, work for installing the cover portion to the grind tab is made to be an automation, as a result, number of man-hour of a whole work can be decreased.

However, in the above patent, since the turret plate is a cross shape, total weight of the grind tub, the abrasive materials and the worked pieces thrown into the grind tub must be limited in a strength problem.

SUMMARY OF THE INVENTION

An object of this invention is to increase strength of the turret plate and to disclose new constitution of a cover portion.

Accordingly, this invention is a grinding device comprising: a rotatable fly-wheel; a turret plate which is located face to face with the fly-wheel and rotates in synchronization with the fly-wheel, the turret plates being formed in a cross shape with four legs extending in a radial direction thereof; four grind tubs located rotatably or oscillatably between the fly-wheel and vicinities of front ends of the legs of the turret plate, each of which has an opening portion above thereof a periphery portion of the opening portion in the grind tab provided on the leg at a position extending horizontally positioning above an horizontal upper edge of the leg; a cover portion installable to the opening portion of the grind tub by sliding; a fix means provided between the cover portion and the grind tub; and a reinforcement means provided on the turret plate.

Furthermore, it is desired that the reinforcement means is a reinforcement plate installed on the turret plate, the reinforcement plate being the same shape as the turret plate. Moreover, it is desired that the reinforcement plate is fixed on the turret plate with a specific distance to the turret plate. Also, it is desired tat each of bearings arranged between the reinforcement plate and the turret plate is provided on a shaft which holds the grind tub to the turret plate and extends between the reinforcement plate and the turret plate to hold a space between the turret plate and the reinforcement plate.

Furthermore, the fix means comprising: a flange portion formed on a periphery of the opening portion in the grind tub; a plurality of fixed pieces extending from specific positions in two side edges along a cover portion sliding direction and facing a lower surface of the flange portion; elliptical fixing members located below the flange portion, which are positioned between said fixed pieces and the flange portion when the cover portion has bee installed on the grind tub, the fixing members being fixed eccentrically on rods extending in the sliding direction; wherein the fixing members press the fixed pieces below by rotating the rods to fix the cover portion to the grind tub, the fixing members separating from the fixed pieces by rotating the rod to release fix of the cover portion.

BRIEF DESCRIPTION OF THE DRAWINGS

In the accompanying drawings, there are shown illustrative embodiments of the invention from which these and other of its objective, novel features, and advantages will be readily apparent.

In the drawings.

DETAILED DESCRIPTION OF THE PREFERRED EMBODIMENT

Figure 1:
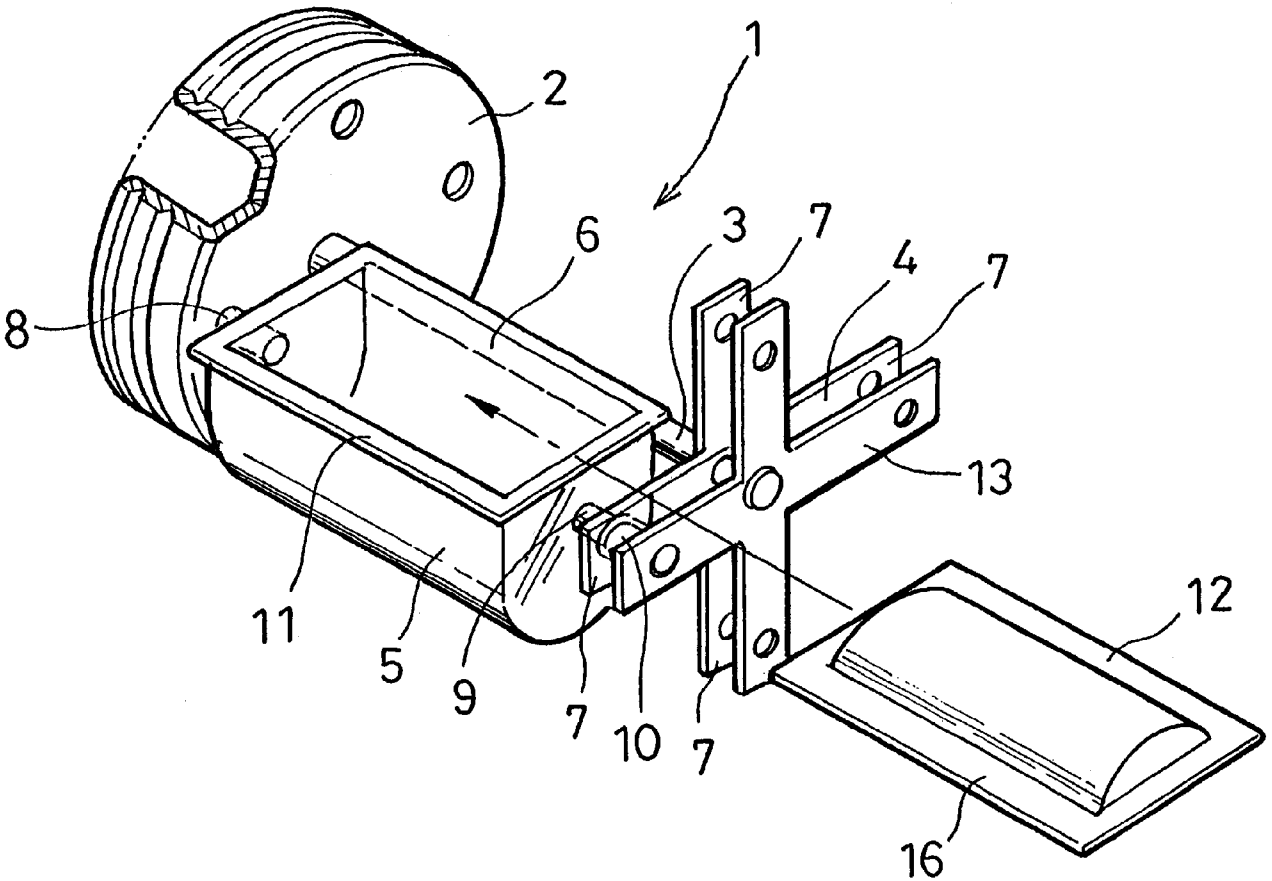
FIG. 1 is a perspective view showing a grinding device according to the present invention.
Figure 2:
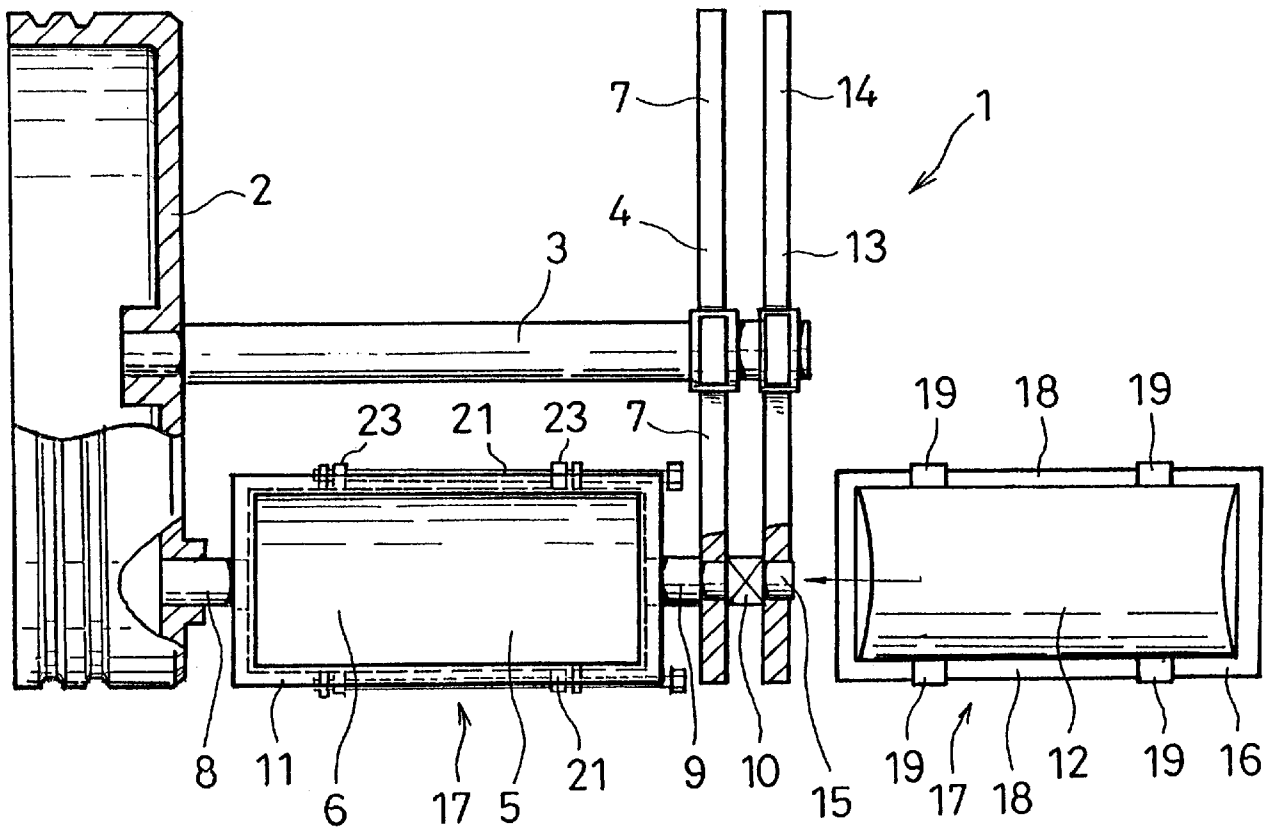
FIG. 2 is a longitudinal section view of the grinding device shown in FIG. 1.
Figure 3:
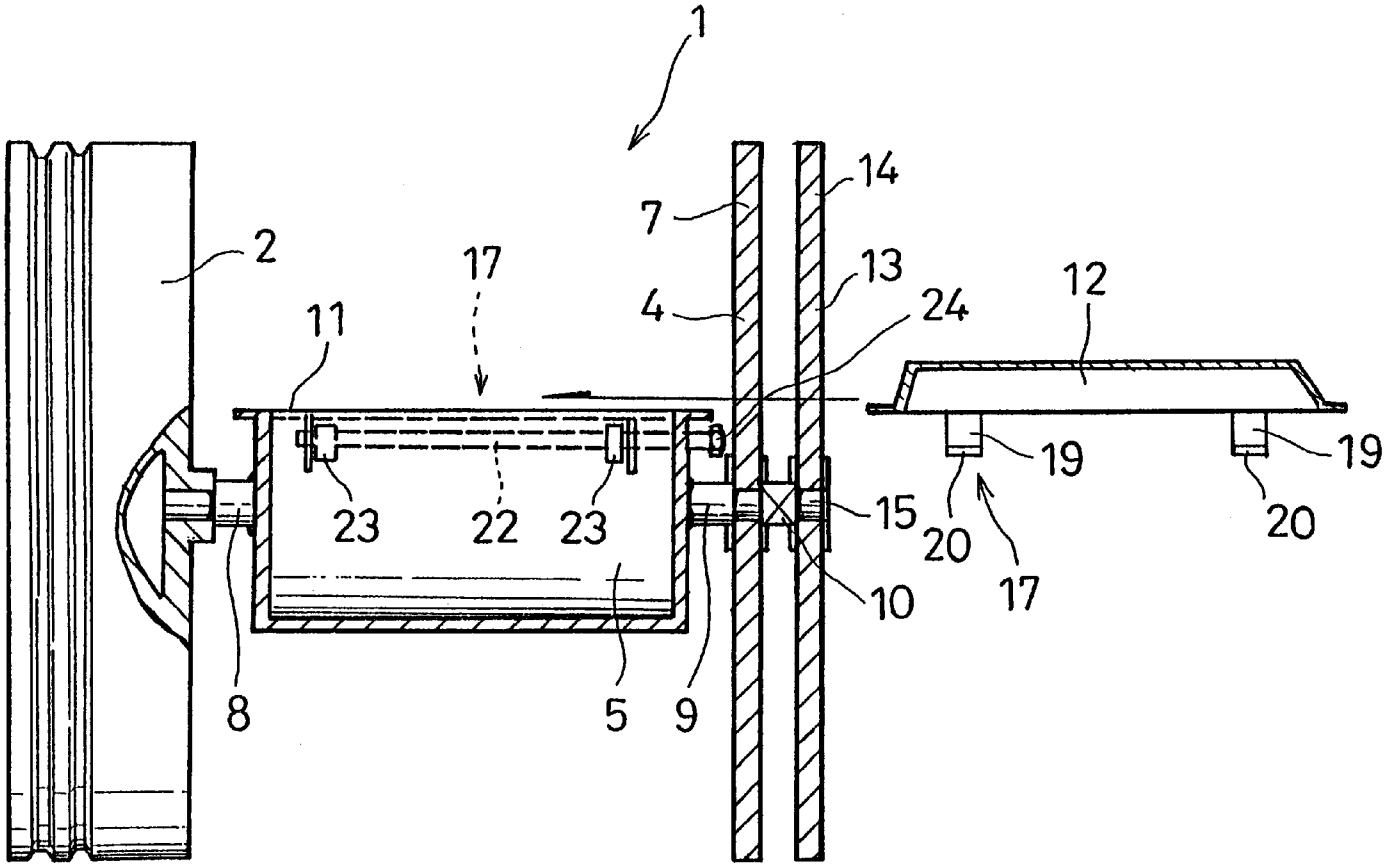
FIG. 3 is a vertical section view showing condition which the cover portion of the grinding device shown in FIG. 1 is released.

Referring now in detail to the drawings, FIGS. 1 through 3 show a rotational or oscillatory type grinding device 1 according to the present invention.

The grinding device 1 has a cylindrical fly-wheel 2 which is rotated by a drive device (not shown) such as a motor and an engine. A turret plate 4 is fixed to the fly-wheel 2 via a shaft 3 in the same axle and rotates with the fly-wheel 2. The turret plate 4 has a plurality of leg portions 7 extending in radial direction of the shaft 3 grind tubs 5 are supported by the shafts 8, 9 rotatably or oscillatably between vicinities of end portions of the leg portions 7 and the fly-wheel 2. In this work mode, as the turret plate has four leg portions 7, four grind tubs are provided.

The grind tub 5 is provided with opening portion 6 through which abrasive materials and worked pieces are thrown in. When one leg portion 7 of the turret plate 4 on which the grind tub 5 is installed moves to a position which the leg portion 7 extends m a horizontal direction, the opening portion 6 is positioned upper than the leg portion 7 extending horizontally. A flange portion 11 extending outwardly is formed at a periphery of the opening portion 6.

The opening portion 6 is enclosed by a cover portion 12 which slides on the flange portion 11 to be installed on the opening portion 6 when the leg portion 7 of the turret plate 4 on which the grind tub 5 is installed is in the position which the leg portion 7 extends in the horizontal direction.

Furthermore, a reinforcement plate 13 which is the same shape as the turret plate 4 is fixed to the turret plate 4 with a specific distance. To put it concretely, leg portions 14 of the reinforcement plate 13 extending in radial directions are positioned so as to face to the leg portions 7 of the turret plate 4, and the reinforcement plate 13 is fixed on the leg portions 7 of the turret plate 4 by a shaft 15 extending from a shaft 9 which is one of shafts supporting the grind tub 5 and a bearing 10 provided around the shaft 15.

Thus, as strength of the turret plate 4 is increased, weight of the abrasive materials and the worked pieces which is thrown into the grind tub 5 may be increased.

Figure 4:
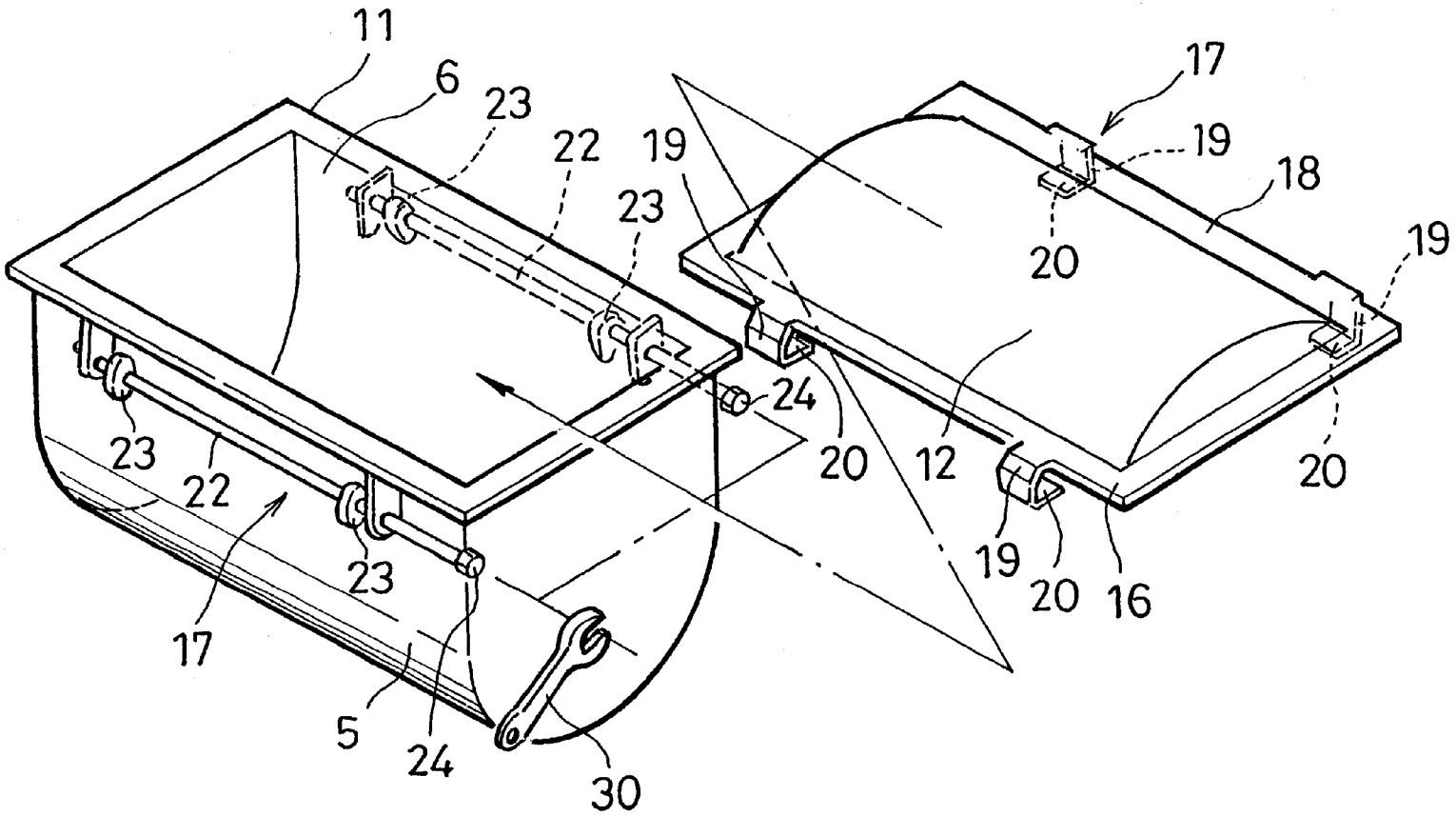
FIG. 4 is an explanation view showing the fixing mechanism of the grind tub and the cover portion.
Figure 5:
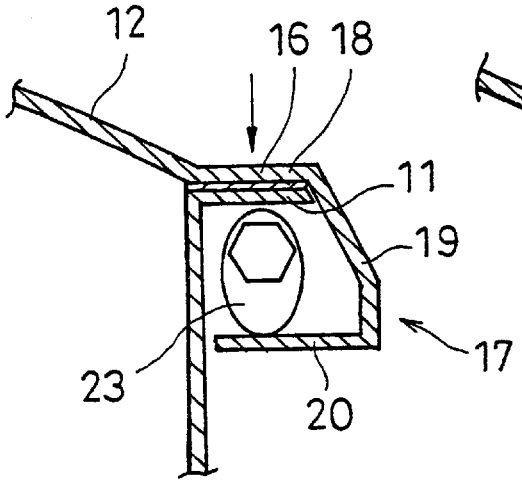
FIG. 5 is an explanation view showing condition that the cover portion is fixed.

A fix mechanism 17 of the cover portion 12 is, as shown in FIGS. 2 through 4, constituted of cover side retaining pieces 19 extending from specific positions of sides which are along a sliding direction of the cover portion 12 on a peripheral portion 16 of the cover portion 12; and a mechanism 21 for fixing and releasing the cover side retaining pieces 19 which is located under the flange portion 11 of the grind tub 5.

Each of the cover side retaining pieces 19 has a fixed piece 20 which is positioned under the flange portion 11 to face in parallel with the flange portion 11 when the cover portion 12 is installed on the grind tub 5.

The mechanism 21 comprises a pair of driving shafts 22 extending rotatably under the flange portion 11 along the sliding direction of the cover portion 12; elliptical cams 23 provided eccentrically at specific positions of the driving shafts 22; and a mechanism 24 for rotating the driving shafts 22 provided at ends of the drive shafts 22.

Figure 6:
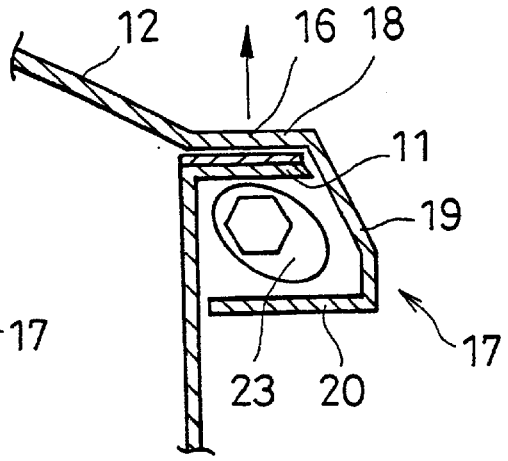
FIG. 6 is an explanation view showing condition that the fix is released.
Figure 7:
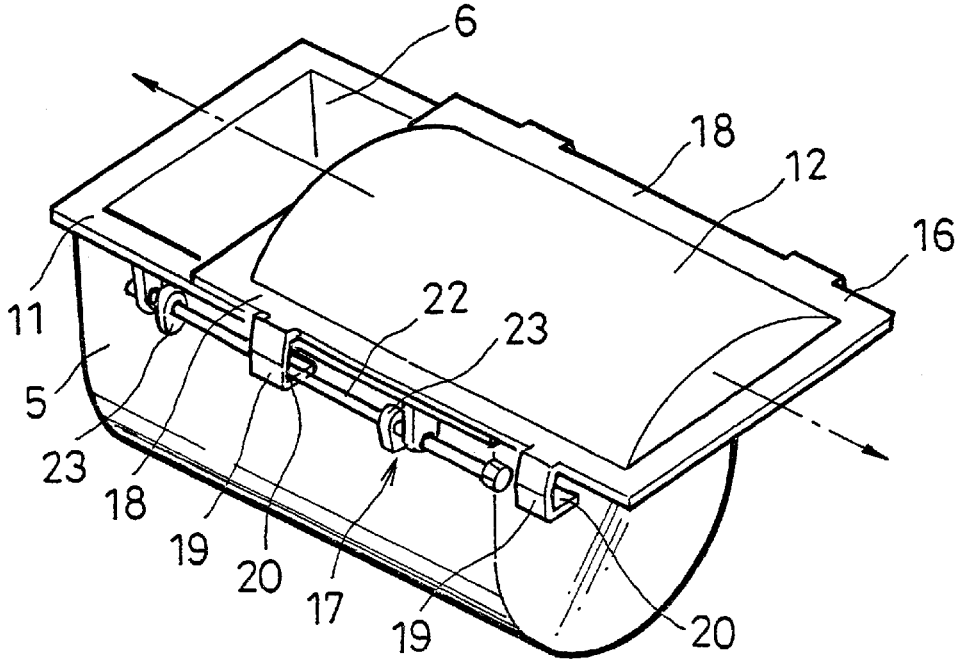
FIG. 7 is an explanation view showing condition that the cover portion is removed.
Figure 8:
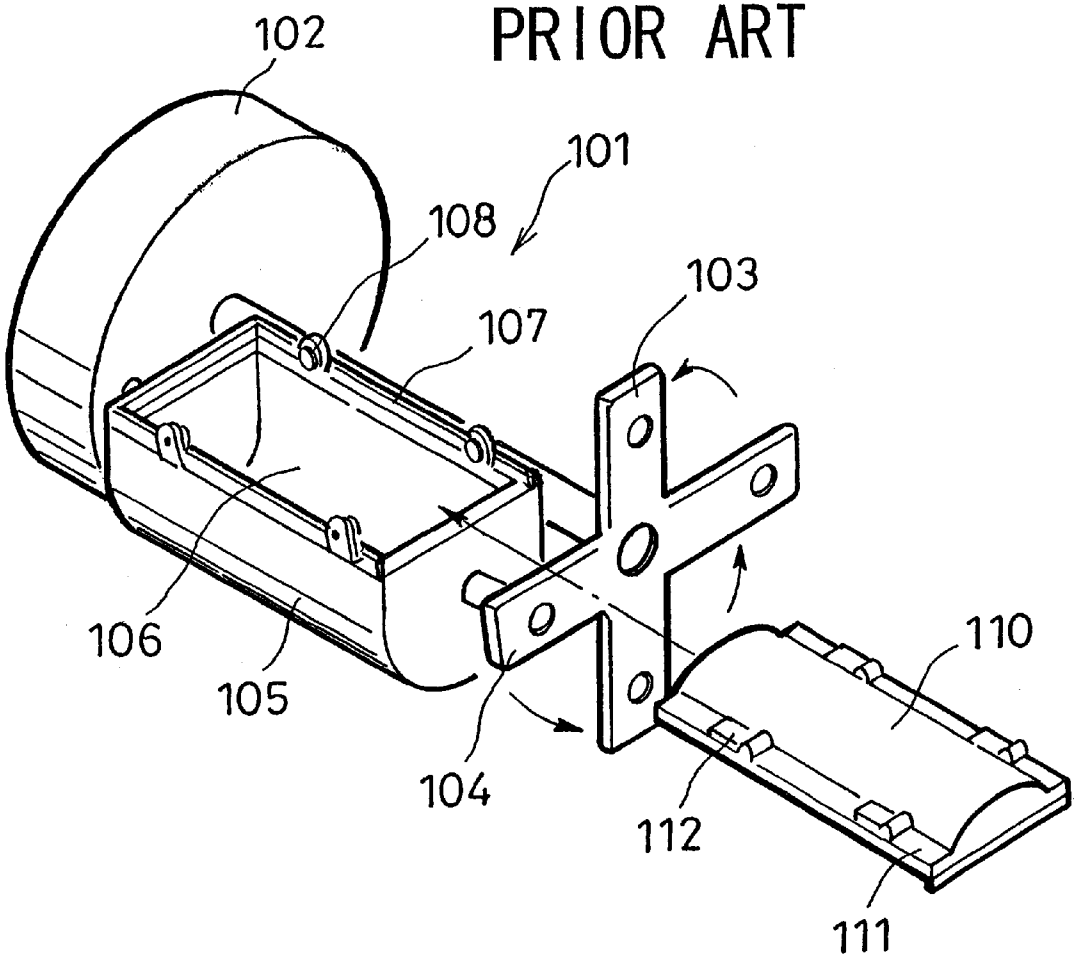
FIG. 8 PRIOR ART
FIG. 8 is a perspective view showing a prior grinding device.
Figure 9:
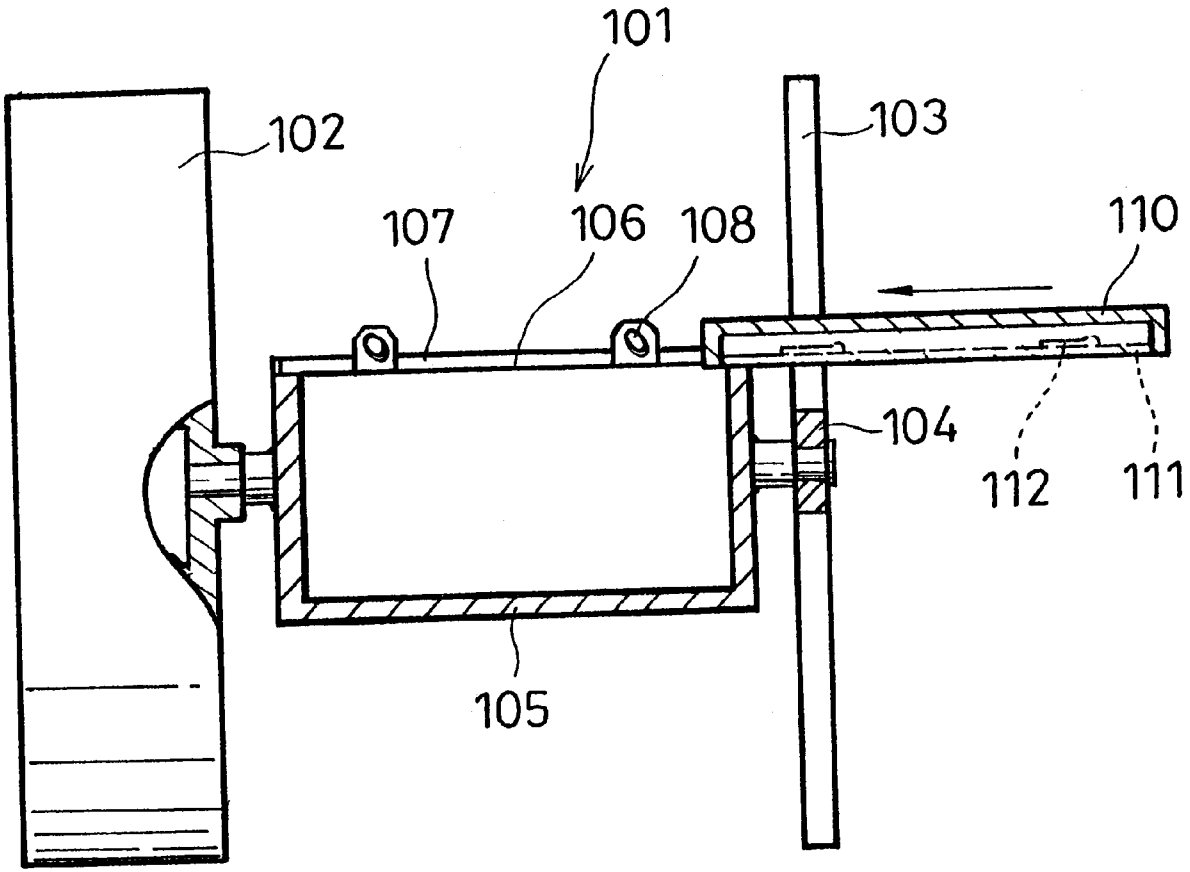
FIG. 9 PRIOR ART
FIG. 9 is a longitudinal section view of the prior grinding device.
Figure 10:
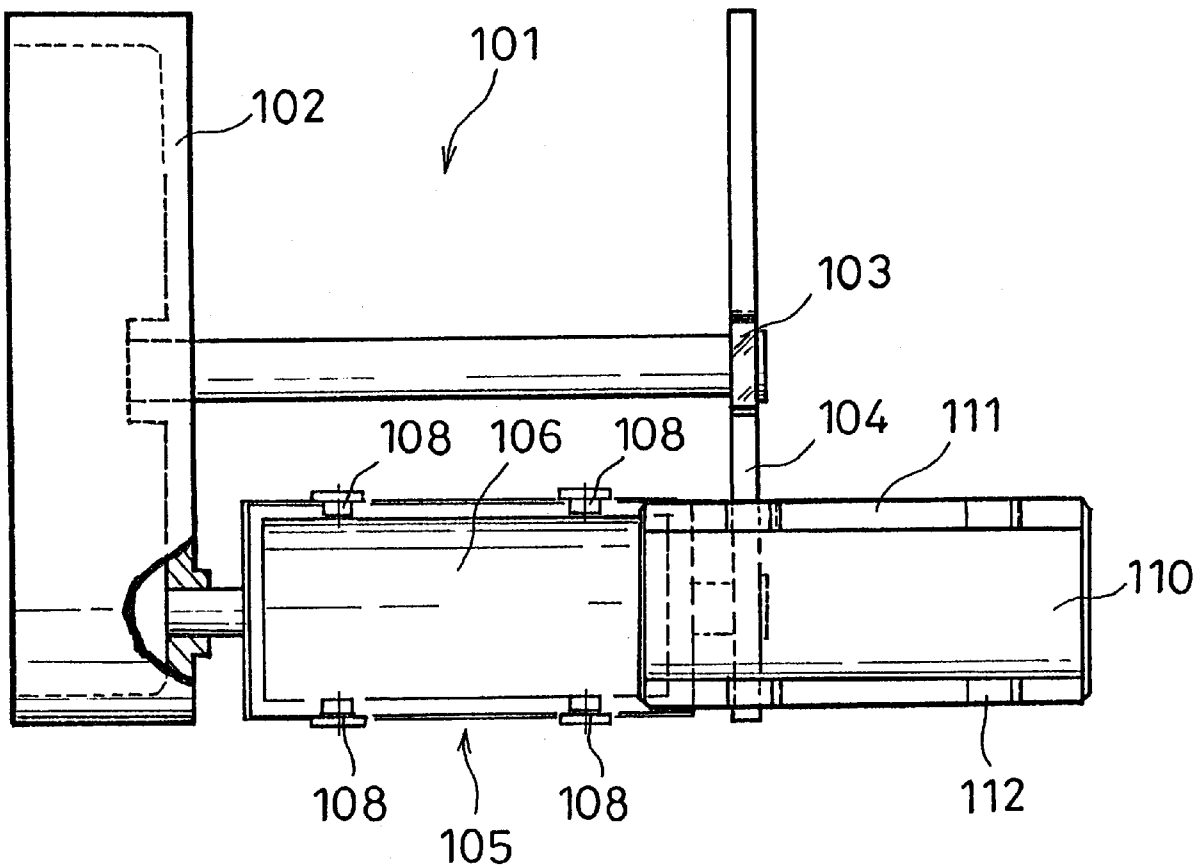
FIG. 10 PRIOR ART
FIG. 10 is an explanation view showing condition that the cover portion is released in the prior grinding device.
Figure 11:
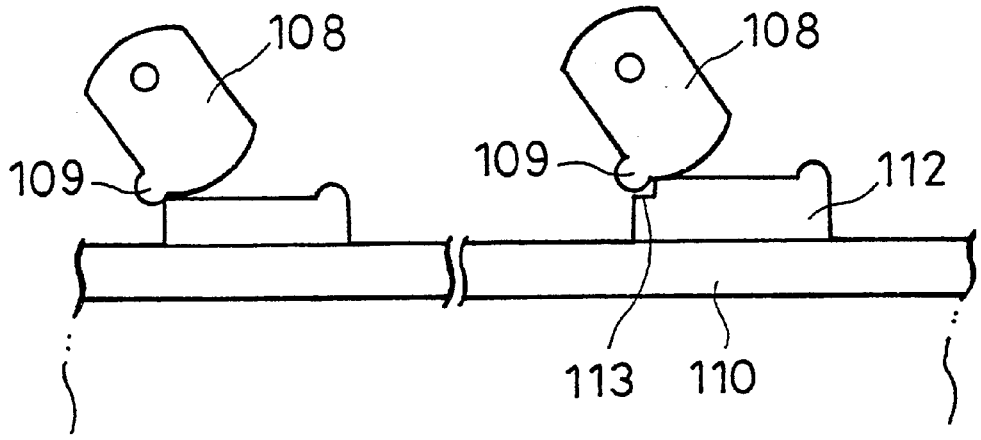
FIG. 11 PRIOR ART
FIG. 11 is an explanation view showing condition before the cover portion is fixed in the prior fixing mechanism.
Figure 12:
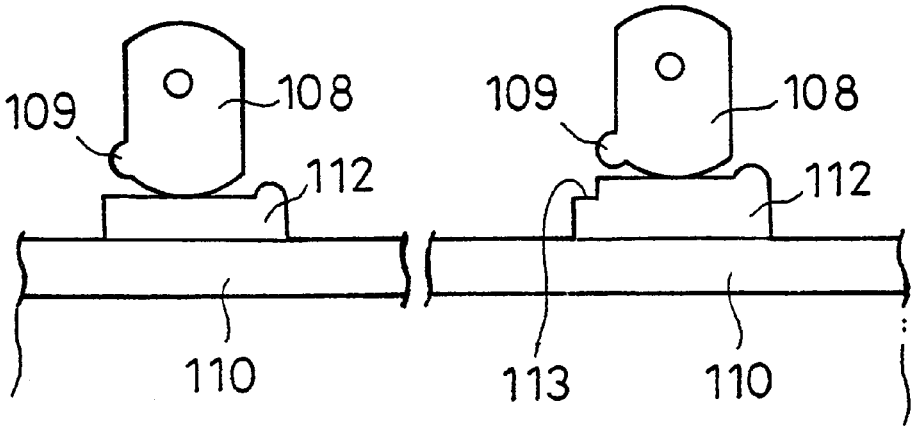
FIG. 12 PRIOR ART
FIG. 12 is an explanation view showing condition that the cover portion is fixed.

In normal condition of the mechanism 21, as shown in FIG. 6, each of the cams 23 is at a slanted position to be released, and the cover portion 12, as shown in FIG. 7, slides on the flange portion 11 of the grind tub 5 provided on the leg portion 7 being at the horizontally extending position to be installed on the grind tub 5. At this time, the cover side retaining pieces 19 move to positions meeting to the cams 23, so that the cams 3 face against the fixed pieces 20. And then, as shown in FIG. 4, the mechanism 24 is rotated by a means for driving such as a wrench 30, so that the cams 23 are erected to press the fixed pieces 20. As a result, the cover portion 12 are fixed on the grind tub 5. After that, the leg portions 7 are made to move to the horizontally extending position in turn, so that the cover portion 12 is installed to the grind tub 5 as the above mentioned in turn. Then, the fly-wheel 2 and the turret plate 4 are rotated to rotate or oscillate the grind tubs 5 in order to grind the worked pieces.

After the grinding work, the mechanism 24 of the grind tub 5 provided at the leg portion 7 moving to the horizontally extending position is rotated by the wrench 30 in order to make the cams 23 slanted and to release the press of the fixed pieces 20, the cover portion 12 sliding on the grind tub 5 to be taken off from the grind tub 5, taking the abrasive materials and the worked pieces out of the grind tub 5. And the grind tubs 5 move to the horizontally extending position in turn, the abrasive materials and the worked pieces are taken out of the grind tub 5 and then grinding process is finished.

The grinding device 1 with a constitution as the above mentioned, as the cover portion can be installed on the grind tub by means of making the cover portion slide on the grind tub, minimization of a setting space necessary to a whole grinding device may be designed. Furthermore, thus, as opening or closing the opening portion of the grind tub can be automatized, workability of grinding may be increased remarkably.

Furthermore, by reinforcing the turret plate by providing the reinforcement plate to the turret plate, the turret plate is made to be double constitution, so that twist or slack of the turret plate may be prevented, as a result, quantity of the working pieces may be increased and accuracy of grinding work may be increased.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claims.

What is claimed is:

1. A grinding device comprising:

a rotatable fly-wheel;

a turret plate which is located face to face with said fly-wheel and rotates in synchronization with said fly-wheel, said turret plates being formed in a cross shape with a plurality of leg portions extending in a radial direction thereof;

a plurality of grind tubs located rotatably or oscillatably between said fly-wheel and vicinities of front ends of said leg portions of said turret plate, each of which has an opening portion above thereof, a periphery portion of said opening portion in said grind tub provided on said leg portion at a position extending horizontally positioning above said leg portion at a horizontally extending position;

a cover portion installable to said opening portion of said grind tub by sliding;

a fix means provided between said cover portion and said grind tub; and a reinforcement means provided on said turret plate.

2. A grinding device according to claim 1, wherein:

said reinforcement means is a reinforcement plate installed on said turret plate, said reinforcement plate being the same shape as said turret plate.

3. A grinding device according to claim 2, wherein:

said reinforcement plate is fixed on said turret plate with a specific distance.

4. A grinding device according claim 3, wherein:

each of bearings arranged between said reinforcement plate and said turret plate is provided on a shaft which holds said grind tub to said turret plate and extends between said reinforcement plate and said turret plate to hold a space between said turret plate and said reinforcement plate.

5. A grinding device according to claim 4, wherein:

said fix means comprising:

a flange portion formed on a periphery of said opening portion in said grind tub;

a plurality of fixed pieces extending from specific positions in two side edges along a cover portion sliding direction and facing a lower surface of said flange portion; and elliptical fixing members located below said flange portion, which are positioned between said fixed pieces and said flange portion when said cover portion has been installed on said grind tub, said fixing members being fixed eccentrically on driving shafts extending in said sliding direction;

wherein said fixing members press said fixed pieces below by rotating said driving shafts to fix said cover portion to said grind tub, said fixing members separating from said fixed pieces by rotating said driving shafts to release fix condition of said cover portion.

6. A grinding device according to claim 3, wherein:

said fix means comprising:

a flange portion formed on a periphery of said opening portion in said grind tub;

a plurality of fixed pieces extending from specific positions in two side edges along a cover portion sliding direction and facing a lower surface of said flange portion; and elliptical fixing members located below said flange portion, which are positioned between said fixed pieces and said flange portion when said cover portion has been installed on said grind tub, said fixing members being fixed eccentrically on driving shafts extending in said sliding direction;

wherein said fixing members press said fixed pieces below by rotting said driving shafts to fix said cover portion to said grind tub, said fixing members separating from said fixed pieces by rotating said driving shafts to release fix condition of said cover portion.

7. A grinding device according to claim 3, wherein:

said fix means comprising:

a flange portion formed on a periphery of said opening portion in said grind tub;

a plurality of fixed pieces extending from specific positions in two side edges along a cover portion sliding direction and facing a lower surface of said flange portion; and elliptical fixing members located below said flange portion, which are positioned between said fixed pieces and said flange portion when said cover portion has been installed on said grind tub, said fixing members being fixed eccentrically on driving shafts extending in said sliding direction;

wherein said fixing members press said fixed pieces below by rotating said driving shafts to fix said cover portion to said grind tub, said fixing members separating from said fixed pieces by rotating said driving shafts to release fix condition of said cover portion.

8. A grinding device according claim 2, wherein:

each of bearings arranged between said reinforcement plate and said turret plate is provided on a shaft which holds said grind tub to said turret plate and extends between said reinforcement plate and said turret plate to hold a space between said turret plate and said reinforcement plate.

9. A grinding device according to claim 8, wherein:

said fix means comprising:

a flange portion formed on a periphery of said opening portion in said grind tub;

a plurality of fixed pieces extending from specific positions in two side edges along a cover portion sliding direction and facing a lower surface of said flange portion; and elliptical fixing members located below said flange portion, which are positioned between said fixed pieces and said flange portion when said cover portion has been installed on said grind tub, said fixing members being fixed eccentrically on driving shafts extending in said sliding direction;

wherein said fixing members press said fixed pieces below by rotating said driving shafts to fix said cover portion to said grind tub, said fixing members separating from said fixed pieces by rotating said driving shafts to release fix condition of said cover portion.

10. A grinding device according to claim 2, wherein:

said fix means comprising:

a flange portion formed on a periphery of said opening portion in said grind tub;

a plurality of fixed pieces extending from specific positions in two side edges along a cover portion sliding direction and facing a lower surface of said flange portion; and elliptical fixing members located below said flange portion, which are positioned between said fixed pieces and said flange portion when said cover portion has been installed on said grind tub, said fixing members being fixed eccentrically on driving shafts extending in said sliding direction;

wherein said fixing members press said fixed pieces below by rotating said driving shafts to fix said cover portion to said grind tub, said fixing members separating from said fixed pieces by rotating said driving shafts to release fix condition of said cover portion.

11. A grinding device according to claim 1, wherein:

said reinforcement plate is fixed on said turret plate with a specific distance.

12. A grinding device according claim 11, wherein:

each of bearings arranged between said reinforcement plate and said turret plate is provided on a shaft which holds said grind tub to said turret plate and extends between said reinforcement plate and said turret plate to hold a space between said turret plate and said reinforcement plate.

13. A grinding device according to claim 12, wherein:

said fix means comprising:

a flange portion formed on a periphery of said opening portion in said grind tub;

a plurality of fixed pieces extending from specific positions in two side edges along a cover portion sliding direction and facing a lower surface of said flange portion; and elliptical fixing members located below said flange portion, which are positioned between said fixed pieces and said flange portion when said cover portion has been installed on said grind tub, said fixing members being fixed eccentrically on driving shafts extending in said sliding direction;

wherein said fixing members press said fixed pieces below by rotating said driving shafts to fix said cover portion to said grind tub, said fixing members separating from said fixed pieces by rotating said driving shafts to release fix condition of said cover portion.

14. A grinding device according to claim 11, wherein:

said fix means comprising:

a flange portion formed on a periphery of said opening portion in said grind tub;

a plurality of fixed pieces extending from specific positions in two side edges along a cover portion sliding direction and facing a lower surface of said flange portion; and elliptical fixing members located below said flange portion, which are positioned between said fixed pieces and said flange portion when said cover portion has been installed on said grind tub, said fixing members being fixed eccentrically on driving shafts extending in said sliding direction;

wherein said fixing members press said fixed pieces below by rotating said driving shafts to fix said cover portion to said grind tub, said fixing members separating from said fixed pieces by rotating said driving shafts to release fix condition of said cover portion.

15. A grinding device according claim 1, wherein:

each of bearings arranged between said reinforcement plate and said turret plate is provided on a shaft which holds said grind tub to said turret plate and extends between said reinforcement plate and said turret plate to hold a space between said turret plate and said reinforcement plate.

16. A grinding device according to claim 15, wherein:

said fix means comprising:

a flange portion formed on a periphery of said opening portion in said grind tub;

a plurality of fixed pieces extending from specific positions in two side edges along a cover portion sliding direction and facing a lower surface of said flange portion; and elliptical fixing members located below said flange portion, which are positioned between said fixed pieces and said flange portion when said cover portion has been installed on said grind tub, said fixing members being fixed eccentrically on driving shafts extending in said sliding direction;

wherein said fixing members press said fixed pieces below by rotating said driving shafts to fix said cover portion to said grind tub, said fixing members separating from said fixed pieces by rotating said driving shafts to release fix condition of said cover portion.

17. A grinding device according to claim 1, wherein:

said fix means comprising:

a flange portion formed on a periphery of said opening portion in said grind tub;

a plurality of fixed pieces extending from specific positions in two side edges along a cover portion siding direction and facing a lower surface of said flange portion; and elliptical fixing members located below said flange portion, which are positioned between said fixed pieces and said flange portion when said cover portion has been installed on said grind tub, said fixing members being fixed eccentrically on driving shafts extending in said sliding direction, wherein said fixing members press said fixed pieces below by rotating said driving shafts to fix said cover portion to said grind tub, said fixing members separating from said fixed pieces by rotating said driving shafts to release fix condition of said cover portion.

* * * * *